US005441186A

United States Patent [19]

Halligan

[11] Patent Number: 5,441,186

[45] Date of Patent: Aug. 15, 1995

[54] SIDE SADDLE CHILD HOLSTER

[76] Inventor: Guy W. Halligan, 11406 Julian Way, Westminster, Colo. 80030

[21] Appl. No.: 126,693

[22] Filed: Sep. 16, 1993

[51] Int. Cl.[6] ..... A47D 13/02

[52] U.S. Cl. ..... 224/159; 224/161; 224/208; 224/270

[58] Field of Search ..... 224/158, 159, 160, 161, 224/208, 270

[56] References Cited

U.S. PATENT DOCUMENTS

| | | | |
|---|---|---|---|
| 781,033 | 1/1905 | Sutter | 224/159 |
| 1,464,404 | 8/1923 | Blekastad | 224/159 |
| 2,056,925 | 10/1936 | Kimbrough | 224/159 |
| 4,790,459 | 12/1988 | Moseley | 224/159 |
| 4,901,898 | 2/1990 | Colombo et al. | 224/159 |
| 4,915,277 | 4/1990 | Larreategui | 224/158 |
| 5,261,584 | 11/1993 | Albert | 224/270 |

FOREIGN PATENT DOCUMENTS

| | | | |
|---|---|---|---|
| 449569 | 6/1936 | United Kingdom | 224/161 |

*Primary Examiner*—Linda J. Sholl

[57] ABSTRACT

The invention is a child carrier worn on the adults hip. It has shoulder straps and a waist belt for support and is designed support a child up to 25 pounds. When the invention is in use the child straddles the adults hip while sitting on the horizontal platform of the carrier. This platform extends out from the adults hip while the verticle support of the frame braces against the thigh. The design allows the childs weight to be displaced over the adults thigh, hip, arm, waist and shoulder while eliminating extreme pressure/weight burdens on any one area of the body.

2 Claims, 4 Drawing Sheets

SIDE SADDLE CHILD HOLSTER

BACKGROUND OF THE INVENTION

The invention is designed to aid an adult carry a child weighing under twenty five pounds with out causing back, arm or other bodily strain common with traditional child carriers.

This is achieved by shifting the child's weight to the adult's hip instead of the arms, back or chest.

The invention differs from other child carriers primarily from it's placement on the adult's body. It is placed on the adult's hip or side as opposed to the back, shoulders or chest. By expanding the natural protrusion of the hip bone, the invention provides an easy manner to carry children under 25 pounds with minimal strain to the adult's body. By basically extending the adult's hip, the invention reduces the enormous amount of strain placed on the arm and shoulder by redistributing the weight to the hip and thigh. This in turn shifts the child's weight more toward the center of gravity, therefore relieving strain on the back upper body. The invention also frees up the use of the adult's arms by not requiring their constant support. The idea for the invention was developed after observing countless parents carring their children on their hips while they pushed a stroller or lugged around some type of baby carrier which proved to be uncomfortable. Hip carrying seems to be a natural and perhaps the easyist way to carry a child. The invention simply improves upon this method by reducing arm and shoulder strain.

In addition, children seem to prefer being carried on their parent's hip for reasons of comfort and visibility.

SUMMARY OF THE INVENTION

The main purpose of the invention is to provide a comfortable device which allows an adult to transport children under 25 pounds. This is achieved by displacing the childs weight over the wearers thigh, waist, arm, hip and shoulder while avoiding an over burden of weight on any one part of the adults body. The composition, use and benefits of the invention will become more clear in the following description and drawings.

BRIEF DESCRIPTION OF THE DRAWING

FIG. 1 illustrates the basic frame of the invention.

DETAILED DESCRIPTION OF THE DRAWING

Figure 1:
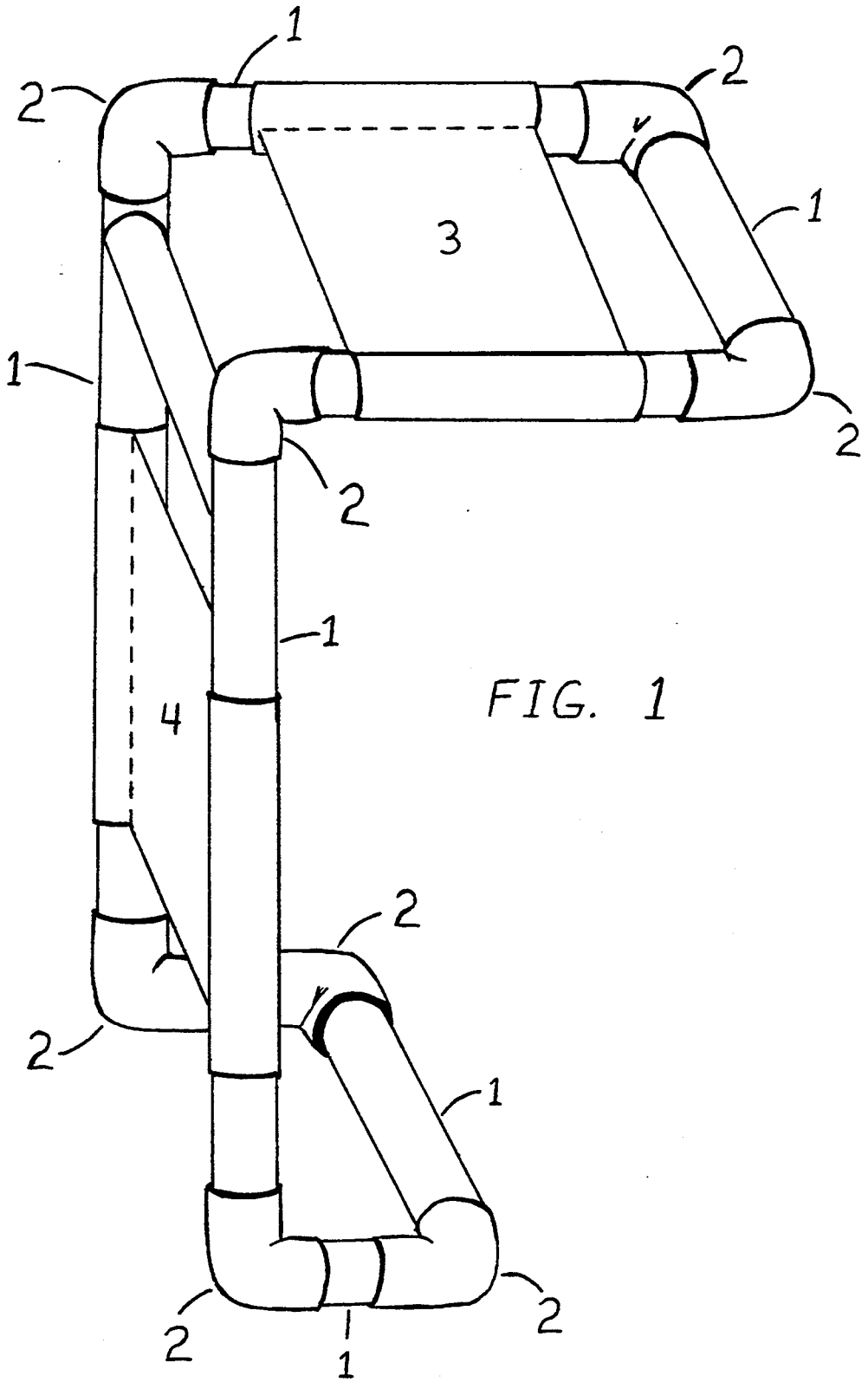
FIG. 1 shows a top side view angle of the invention without the shoulder strap, waist strap or removable back support.

The frame consists of ½" PVC piping FIG. 1, part 1. Joining the ½" PVC piping are eight ½" PVC elbow joints FIG., part 2. These joints are bonded together by PVC glue. The seat FIG. 1, part 3 is comprised of canvas which is sewn in such a fashion that allows the ½" PVC piping to slide through canvas sleeves thereby attaching the canvas seat securely to the frame. The thigh support/brace FIG. 1, part 4 is comprised of the same material as the seat FIG. 1, part 3 and is attached in the same fashion.

Figure 2:
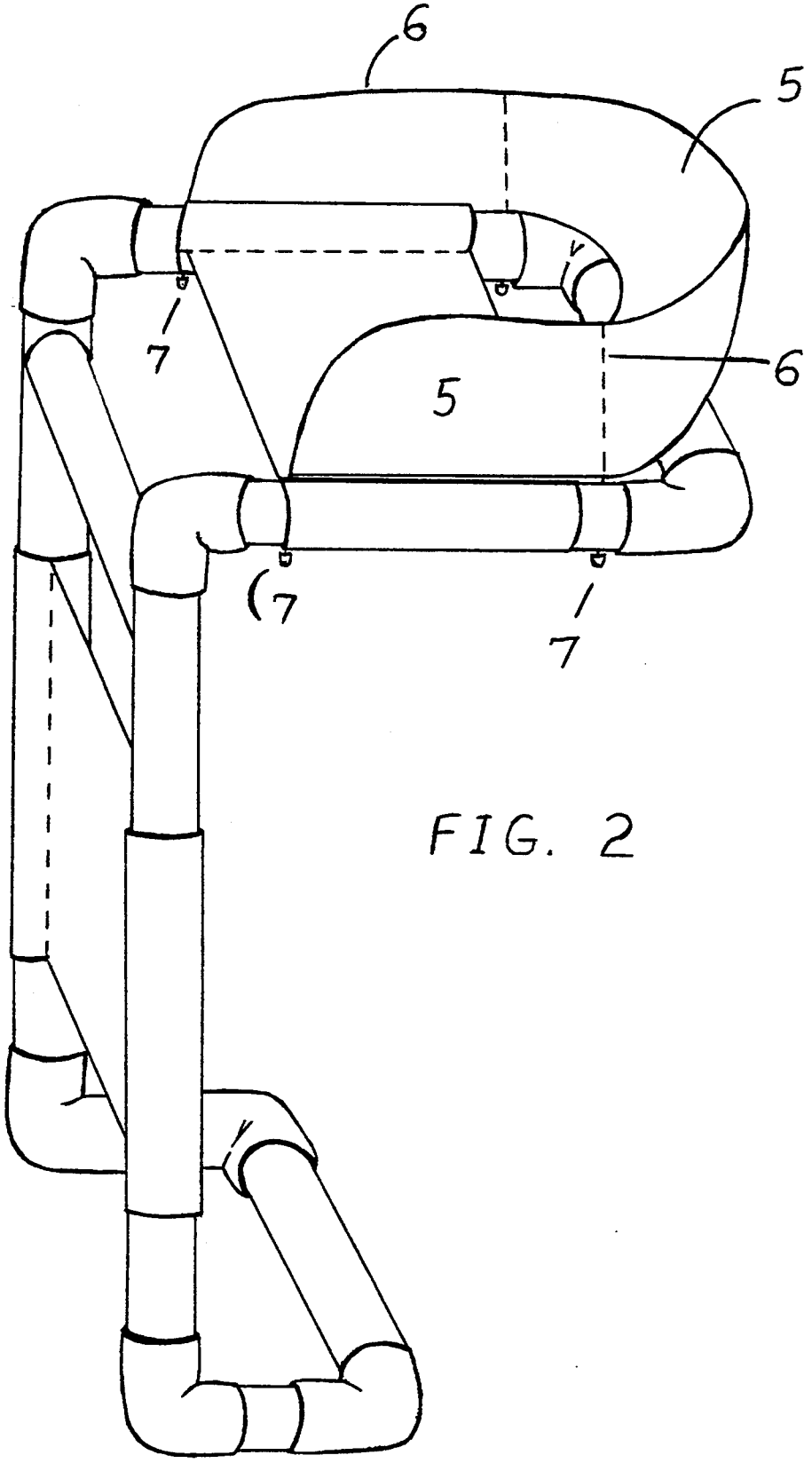
FIG. 2 represents the device with the addition of the removable back support using the same view as shown in FIG. 1.
Figure 3:
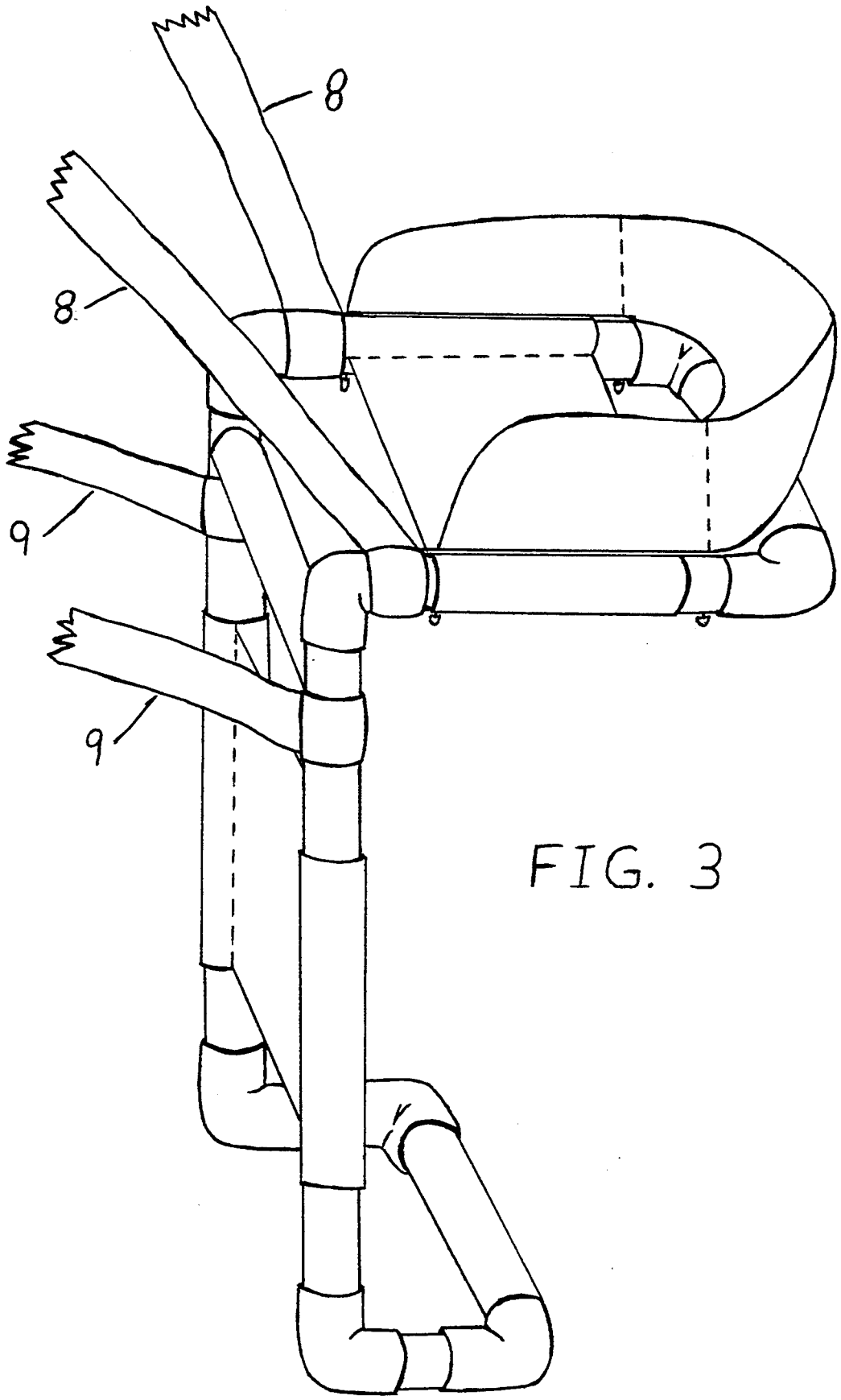
FIG. 3 is the same view shown in FIG. 1 and 2 with the addition of the support shoulder and waist strapping.
Figure 4:
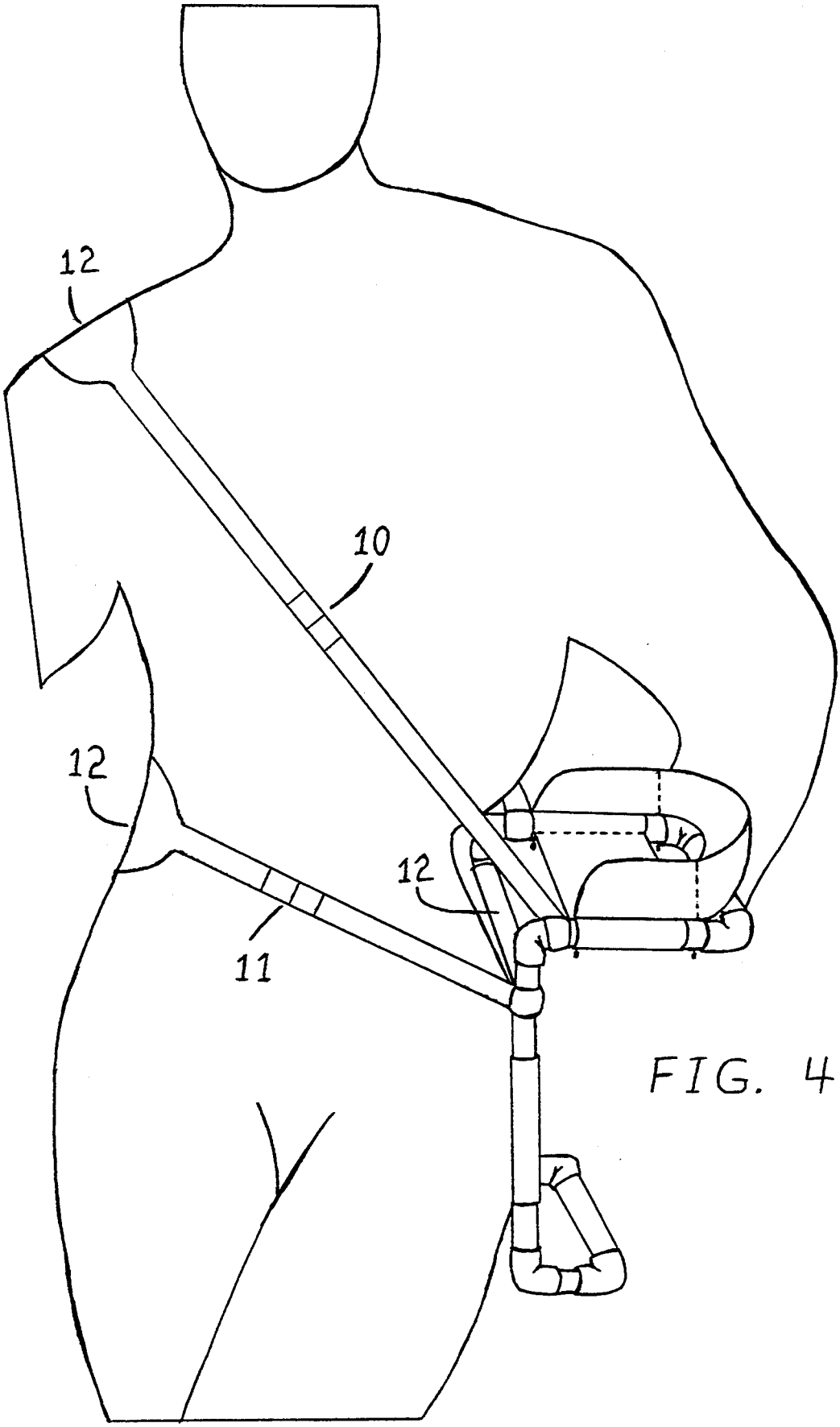
FIG. 4 illustrates the invention attached to an adult and employed ready for use.

The removable back support FIG. 2, part 5 is fabricated from canvas and framed for support by a canvas covered, padded rigid wire FIG. 2, part 6 which is fixed to the PVC frame work by four wing nuts FIG. 2, part 7 attached to the threaded wire frame. The four threaded ends of the removable back support are inserted through their respective holes in the PVC frame and fastened in place with wing nuts from the bottom. The shoulder strapping FIG. 3, part 8 is adjustable with a belt buckle FIG. 4, part 10 as well as the waist strapping FIG. 4, part 9 and belt buckle FIG. 4, part 11. The weight bearing pressure points of the shoulder and hips will be heavily padded with foam FIG. 4, part 12.

I claim:

1. A child carrier adapted to be worn by an adult for supporting and transporting a child comprising:

first and second vertical frame members having a top end and a bottom end;

first and second horizontal frame members having a first end and a second end;

the top end of the first vertical frame member being attached to the first end of the first horizontal frame member forming a first inverted L-shaped member and the top end of the second vertical frame member being attached to the first end of the second horizontal frame member forming a second inverted L-shaped frame member;

at least one cross frame member attaching together and spacing the first and second inverted L-shaped frame members; the first and second inverted L-shaped frame members and the at least one cross frame member together forming a seat frame;

a fabric seat for holding the child having a first side attached to the first horizontal frame member and a second side attached to the second horizontal frame member;

a fabric thigh support for resting against a thigh of the adult having a first side attached to the first vertical frame member and a second side attached to the second frame member;

a waist strap for securing the seat frame on the adult having a first end attached to the first vertical frame member and a second end attached to the second vertical frame member; and a shoulder strap for securing the seat frame on the adult having a first end attached to the first horizontal frame member and a second end attached to the second horizontal frame member.

2. The child carrier as defined in claim 1 further comprising a removable back support attached to the first and second horizontal frame members; said back support including a padded wire frame and fabric panels.

* * * * *